US010006639B2

(12) United States Patent
Johnson

(10) Patent No.: US 10,006,639 B2
(45) Date of Patent: Jun. 26, 2018

(54) APPLIANCE SIDE PANEL WITH AIR CHANNEL

(71) Applicant: General Electric Company, Schenectady, NY (US)

(72) Inventor: Eric Scott Johnson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 521 days.

(21) Appl. No.: 14/531,166

(22) Filed: Nov. 3, 2014

(65) Prior Publication Data

US 2016/0123601 A1 May 5, 2016

(51) Int. Cl.

| | |
|---|---|
| ***F24C 15/00*** | (2006.01) |
| ***A47B 96/20*** | (2006.01) |
| *A47B 77/08* | (2006.01) |

(52) U.S. Cl.

CPC ..... *F24C 15/006* (2013.01); *A47B 96/20* (2013.01); *A47B 77/08* (2013.01)

(58) Field of Classification Search

CPC ..... F24C 15/006; A47B 96/20; A47B 77/08

USPC ..... 126/273 R

See application file for complete search history.

(56) References Cited

U.S. PATENT DOCUMENTS

| | | | | |
|---|---|---|---|---|
| 2,864,932 | A * | 12/1958 | Forrer | A21B 2/00 126/21 R |
| 4,331,124 | A * | 5/1982 | Seidel | F24C 14/025 126/21 A |
| 4,886,042 | A * | 12/1989 | Bessler | F24C 15/08 126/21 R |
| 7,650,881 | B2 * | 1/2010 | Brown | F24C 15/006 126/193 |
| 7,814,896 | B2 | 10/2010 | Chacko et al. | |
| 2010/0276412 | A1 * | 11/2010 | Nam | F24C 15/006 219/392 |
| 2016/0025352 | A1 * | 1/2016 | Lee | F24C 15/006 219/391 |

FOREIGN PATENT DOCUMENTS

| | | | | |
|---|---|---|---|---|
| DE | 3104712 | A1 * | 8/1982 | F24C 7/082 |

OTHER PUBLICATIONS

English Translation of DE 3104712 A1.*

* cited by examiner

*Primary Examiner* — Alfred Basichas

(74) *Attorney, Agent, or Firm* — Dority & Manning, P.A.

(57) ABSTRACT

An oven range appliance with features for cooling one or both side panels of the oven range appliance without visible gaps between the oven range appliance and a set of kitchen cabinets is provided. In particular, an oven range appliance with one or both side panels comprising air channels for a flow of air along one or both side panels is provided. A side panel for an oven range appliance, with features such as an air channel for cooling the side panel, also is provided.

19 Claims, 9 Drawing Sheets

APPLIANCE SIDE PANEL WITH AIR CHANNEL

FIELD OF THE INVENTION

The subject matter of the present disclosure relates generally to appliance side panels with air channels for a flow of air along the side panel, in particular for oven range appliances to help keep the side panels cool.

BACKGROUND OF THE INVENTION

Oven range appliances generally include a casing that defines a cooking chamber for baking or broiling food items therein, as well as a cooktop for cooking food items thereon. Such oven range appliances may be received with a set of kitchen cabinets such that one or both of a pair of opposing side panels of the casing are flush against, or in very close proximity to, the set of kitchen cabinets. When the cooking chamber and/or the cooktop are in use, the side panels of the casing typically become heated, and the heat may be transferred to the kitchen cabinets because of their proximity to one or both of the side panels. The transfer of the heat to the cabinets may, e.g., damage the cabinets or pose a safety hazard. Thus, a typical side panel has one or more recessed portions that are not flush to the cabinets.

However, the recessed portions may trap stagnant air between the side panel and the cabinets. Although the trapped air may somewhat reduce the transfer of heat to the kitchen cabinets, it is not an effective means of reducing the transfer of heat to the cabinets. Further, visible gaps between the oven range appliance and the kitchen cabinets usually are undesirable to consumers.

Accordingly, an oven range appliance with features for cooling one or both side panels of the oven range appliance without visible gaps between the oven range appliance and a set of kitchen cabinets would be beneficial. A side panel for an oven range appliance with features for cooling the side panel also would be useful.

BRIEF DESCRIPTION OF THE INVENTION

The present invention provides an oven range appliance with features for cooling one or both side panels of the oven range appliance without visible gaps between the oven range appliance and a set of kitchen cabinets. In particular, an oven range appliance with one or both side panels comprising air channels for a flow of air along one or both side panels is provided. A side panel for an oven range appliance, with features such as an air channel for cooling the side panel, also is provided. Additional aspects and advantages of the invention will be set forth in part in the following description, may be apparent from the description, or may be learned through practice of the invention.

In a first exemplary embodiment, an oven range appliance is provided. The oven range appliance defines vertical, lateral, and transverse directions that are perpendicular to each other. The oven range appliance includes a casing defining a cooking chamber for receipt of food items for cooking, the casing having a pair of opposing side panels. At least one side panel of the pair of opposing side panels comprises a bottom end and a top end spaced apart along the vertical direction, and a first portion and a second portion, wherein the second portion of the side panel is recessed along the lateral direction such that the first portion and second portion define an air channel for a flow of air along the at least one side panel.

In a second exemplary embodiment, a side panel for an oven range appliance is provided. The side panel includes a bottom end and a top end spaced apart along a vertical direction; a first portion; and a second portion. The second portion of the side panel is recessed along a lateral direction such that the first portion and second portion define an air channel for a flow of air along the side panel.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
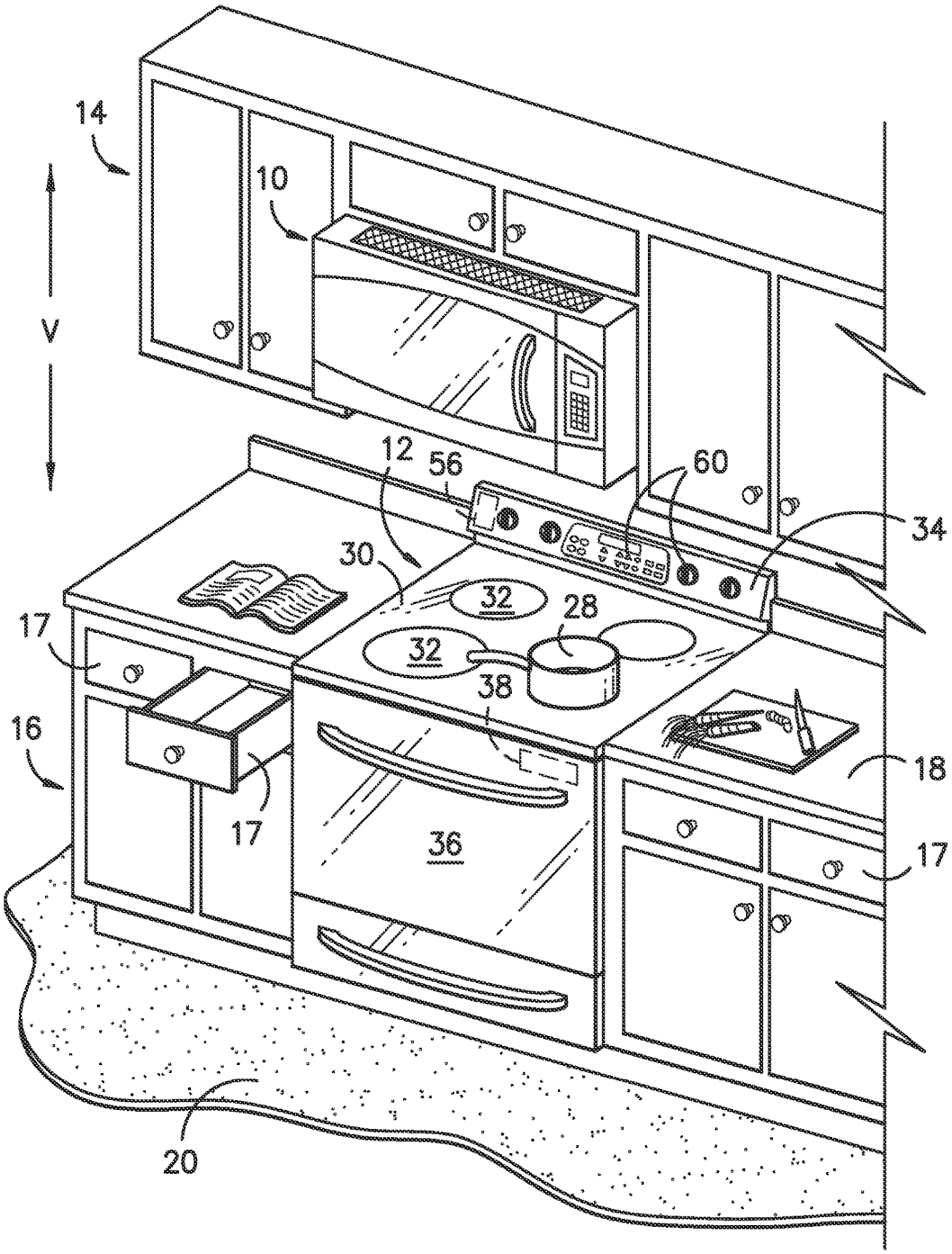
FIG. 1 provides a perspective view of an oven range appliance received within a set of kitchen cabinets according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of an oven range appliance 12 received within a set of kitchen cabinets. Oven range appliance 12 is provided by way of example only and is not intended to limit the present subject matter in any aspect. Thus, the present subject matter may be used with other oven appliance configurations, e.g., that define one or more interior cavities for the receipt of food and/or that are wall mounted. Further, the present subject matter may be used in any other suitable appliance.

FIG. 1 also illustrates a microwave appliance 10, commonly referred to as an over-the-range microwave, mounted to an upper set of kitchen cabinets 14 above an oven range appliance 12, e.g., along a vertical direction V. Upper set of kitchen cabinets 14 is positioned above a base set of kitchen cabinets 16, e.g., along the vertical direction V. Base set of kitchen cabinets 16 includes countertops 18 and drawers 17, and base set of kitchen cabinets 16 are supported on a floor 20. Oven range appliance 12 having a cooktop 30 is received within base set of kitchen cabinets 16.

Cooktop 30 of range 12 includes heated portions 32 that may be heated by heating elements (not shown), e.g., electrical resistive heating elements, gas burners, induction heating elements, and/or any other suitable heating element or combination of heating elements. Cooking utensils, such as cooking utensil 28, may be placed on heated portions 32 to cook or heat food items. Oven range appliance 12 also includes a door 36 that permits access to a cooking chamber 42 (FIG. 3) of oven range appliance 12, e.g., for cooking or baking of food items therein. A control panel 34 of oven range appliance 12 can permit a user to make selections for cooking of food items, e.g., a duration of a cooking cycle of oven range appliance 12 and/or a power setting for the cooking cycle of oven range appliance 12.

Figure 2:
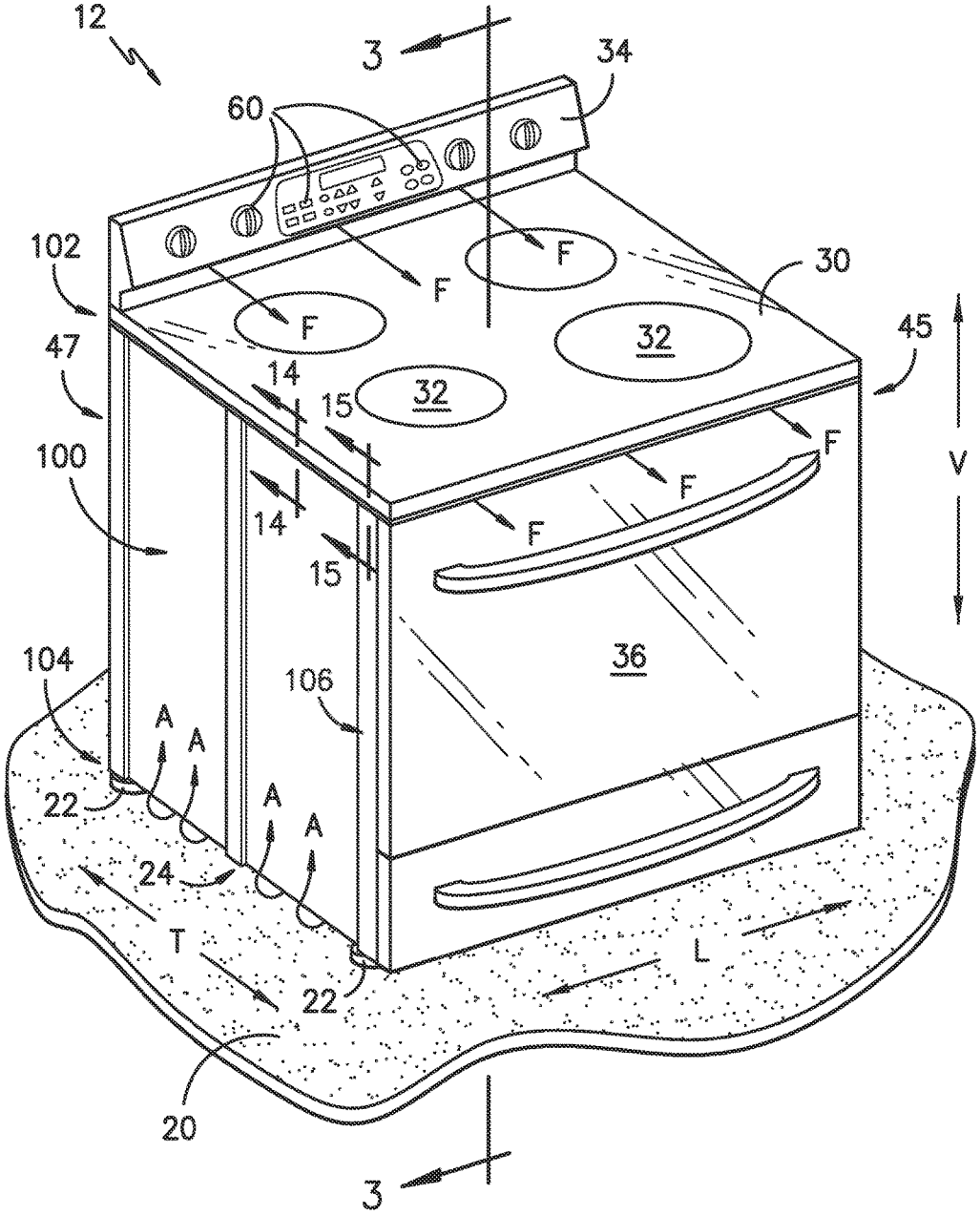
FIG. 2 provides a side, perspective view of the oven range appliance of FIG. 1.

FIG. 2 provides a side, perspective view of oven range appliance 12. Oven range appliance 12 comprises a plurality of feet 22 supporting appliance 12 on floor 20. Further, oven range appliance 12 includes a pair of opposing side panels spaced apart along a lateral direction L. As illustrated, an exemplary side panel 100 of the pair of side panels extends along a transverse direction T from a front portion 45 of a casing 40 (FIG. 3) of appliance 12 toward a back portion 47 of casing 40. Side panel 100 also extends along the vertical direction V from cooktop 30 toward floor 20. As will be readily understood, one or both of the opposing side panels may be constructed like exemplary side panel 100. Side panel 100 is described more fully below.

Figure 3:
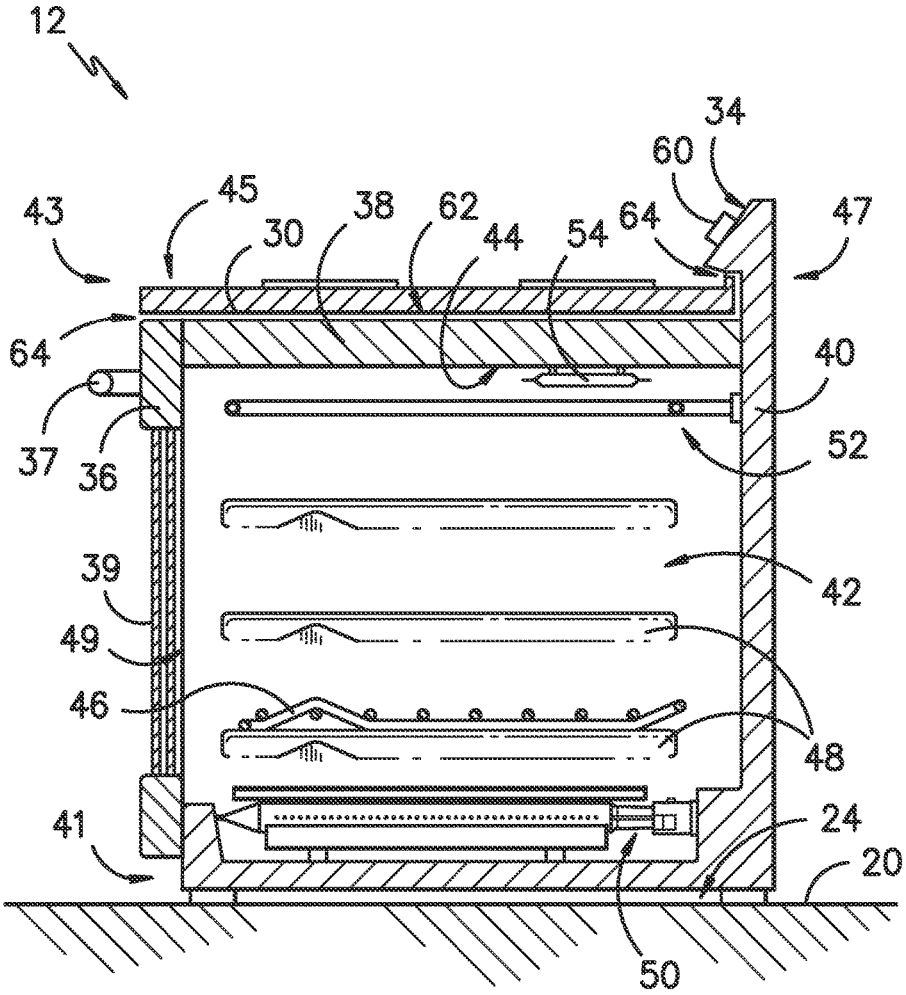
FIG. 3 provides a cross-section view of the oven range appliance of FIG. 1.

FIG. 3 provides a cross-section view of oven range appliance 12. As illustrated, oven range appliance 12 includes an insulated casing 40 with an interior cooking chamber 42 defined by an interior surface 44 of casing 40. Cooking chamber 42 is configured for the receipt of one or more food items to be cooked, and a layer of insulation 38 may be positioned around cooking chamber 42. As shown, feet 22 of oven range appliance 12 support appliance 12 on floor 20 such that a space 24 is defined between floor 20 and a bottom portion 41 of casing 40.

Range appliance 12 includes a door 36 pivotally mounted to casing 40, e.g., with one or more hinges (not shown). A handle 37 is mounted to door 36 and assists a user with opening and closing door 36 to access cooking chamber 42 through an opening 49 defined in front portion 45. For example, a user can pull on handle 37 to open or close door 36 and access cooking chamber 42. Further, oven range appliance 12 can include a seal (not shown) between door 36 and casing 40 that assists with maintaining heat and cooking fumes within cooking chamber 42 when door 36 is closed as shown in FIG. 2. Multiple parallel glass panes 39 provide for viewing the contents of cooking chamber 42 when door 36 is closed and assist with insulating cooking chamber 42. A baking rack 46 is positioned in cooking chamber 42 for the receipt of food items or utensils containing food items. Baking rack 46 is slidably received onto embossed ribs or sliding rails 48 such that rack 46 may be conveniently moved into and out of cooking chamber 42 when door 36 is open.

A gas fueled or electric bottom heating element 50 (e.g., a gas burner or a bake gas burner) is positioned in casing 40, e.g., at bottom portion 41 of casing 40. Bottom heating element 50 is used to heat cooking chamber 42 for both cooking and cleaning of oven range appliance 12. The size and heat output of bottom heating element 50 can be selected based on the e.g., the size of oven range appliance 12.

As shown in FIG. 3, in some embodiments of oven range appliance 12, a top heating element 52 may also be positioned in cooking chamber 42 of casing 40, e.g., at a top portion 43 of casing 40. Top heating element 52 is used to heat cooking chamber 42 for both cooking/broiling and cleaning of oven range appliance 12. Like bottom heating element 50, the size and heat output of top heating element 52 can be selected based on the e.g., the size of oven range appliance 12. In the exemplary embodiment shown in FIG. 2, top heating element 52 is shown as an electric resistance heating element. However, in alternative embodiments, a gas, microwave, halogen, or any other suitable heating element may be used instead of electric resistance heating element 52, and in other embodiments, top heating element 52 may be omitted.

The operation of oven range appliance 12, including heating elements 50 and 52, is controlled by a processing device such as a controller 56 (FIG. 1), which may include a microprocessor or other device that is in communication with such components. Such controller 56 may also be communication with a temperature sensor 54 that is used to measure temperature inside cooking chamber 42 and provide such measurements to the controller 56. Temperature sensor 54 is shown in the top and rear of cooking chamber 42. However, other locations may be used and, if desired, multiple temperature sensors may be applied as well.

Controller 56 is operatively coupled or in communication with various other components of oven range appliance 12, including controls 60. In response to user manipulation of controls 60, controller 56 operates the various components of oven range appliance 12 to execute selected cycles and features.

Controller 56 may include a memory and microprocessor, such as a general or special purpose microprocessor operable to execute programming instructions or micro-control code associated with a cleaning cycle. The memory may represent random access memory such as DRAM, and/or read only memory such as ROM or FLASH. In one embodiment, the processor executes programming instructions stored in memory. The memory may be a separate component from the processor or may be included onboard within the processor. Alternatively, controller 56 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Controls 60 and other components of oven range appliance 12 may be in communication with controller 56 via one or more signal lines or shared communication busses.

Figure 4:
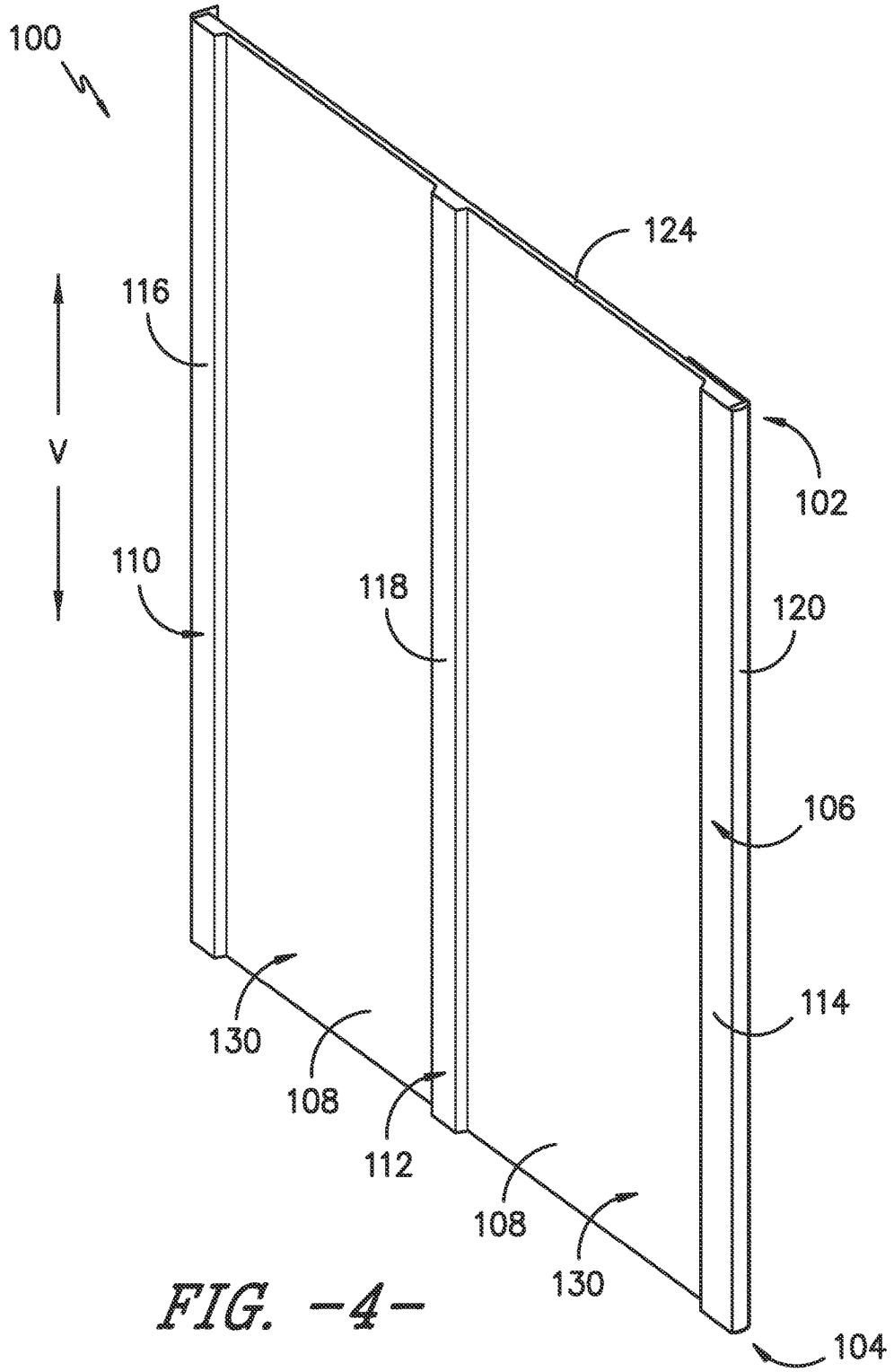
FIG. 4 provides a perspective view of an exemplary embodiment of a side panel of the oven range appliance of FIG. 1 according to the present subject matter.
Figure 5:
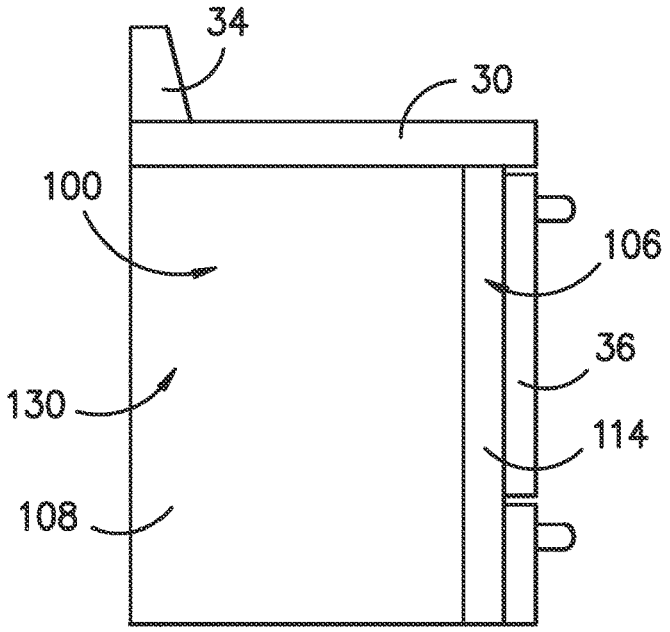
FIGS. 5 through 11 provide schematic views of other exemplary embodiments of a side panel of the oven range appliance of FIG. 1 according to the present subject matter.
Figure 6:
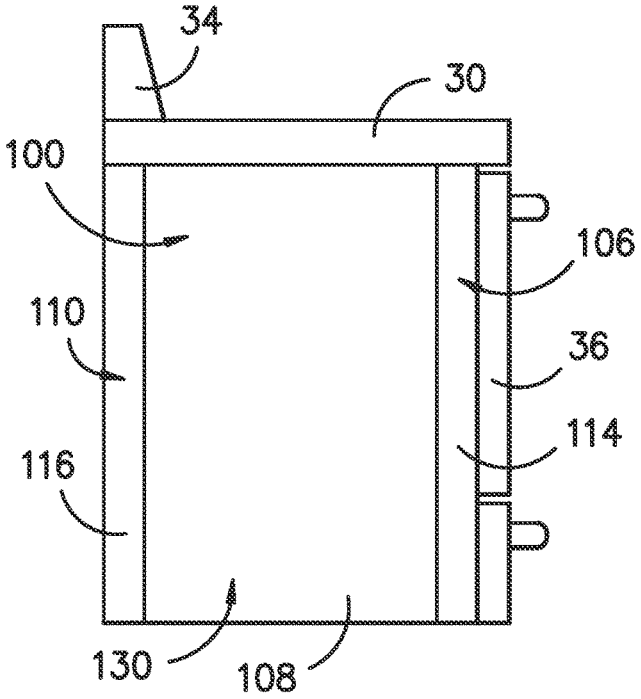

FIG. 4 illustrates an exemplary embodiment of side panel 100. As previously stated, side panel 100 extends along the vertical direction V between a top end 102 and a bottom end 104. As shown in FIG. 2, when side panel 100 is at least one of the opposing side panels of oven range appliance 12, top end 102 is positioned adjacent cooktop 30, and bottom end 104 is positioned adjacent space 24 defined between floor 20 and the bottom portion 41 of casing 40.

Side panel 100 includes a first portion 106, second portion 108, and third portion 110. First portion 106 is positioned adjacent front portion 45 of oven range 12 (FIG. 2), and first portion 106 is spaced apart from third portion 110 along the transverse direction T. Second portion 108 extends between first portion 106 and third portion 110. First portion 106, second portion 108, and third portion 110 are each generally rectangular in shape and extend along the vertical direction V between top end 102 and bottom end 104. Further, side panel 100 may include a rib portion 112 that is generally rectangular in shape and extends along the vertical direction V between top end 102 and bottom end 104. Rib portion 112 may be positioned between first portion 106 and third portion 110, e.g., approximately equidistant from first portion 106 and third portion 110, such that second portion 108 extends between first portion 106 and rib portion 112 and between rib portion 112 and third portion 110. In some embodiments, rib portion 112 may be positioned in other locations between first portion 106 and third portion 110. In other embodiments of side panel 100, more than one rib portion 112 may be included.

Second portion 108 is recessed along the lateral direction L such that first portion 106, second portion 108, third portion 110, and/or rib portion 112 form an air channel 130. For example, in the embodiment illustrated in FIG. 4, first portion 106, second portion 108, and rib portion 112 form a first air channel 130, and rib portion 112, second portion 108, and third portion 110 form a second air channel 130.

Figure 12:
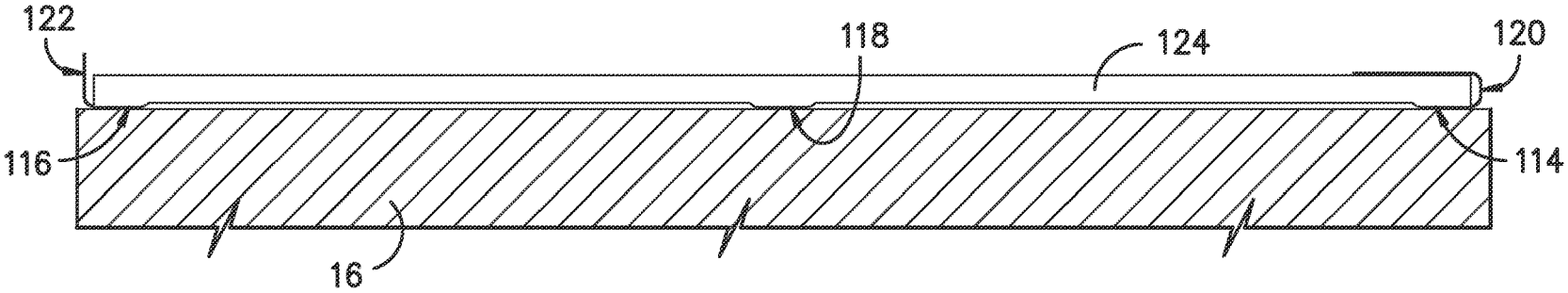
FIG. 12 provides a top view of the side panel of FIG. 4 positioned adjacent a set of kitchen cabinets.
Figure 13:
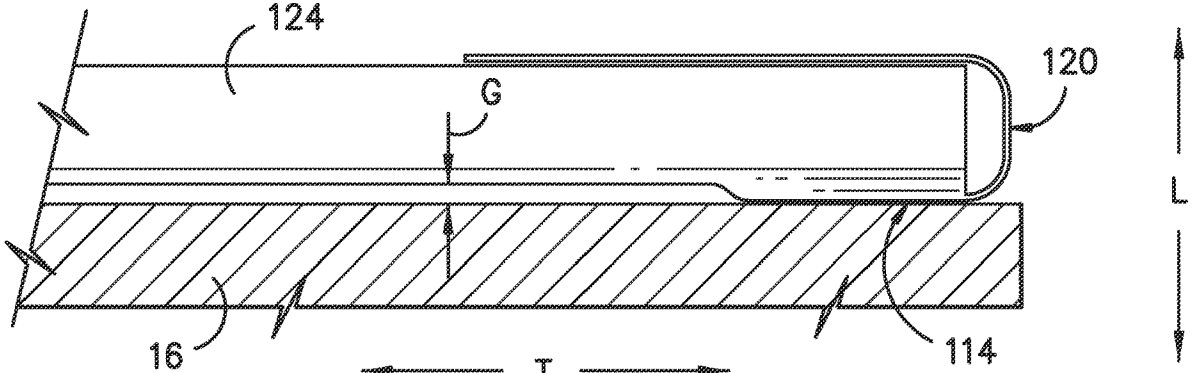
FIG. 13 provides an enlarged, partial top view of the side panel of FIG. 4 positioned adjacent a set of kitchen cabinets.
Figure 15:
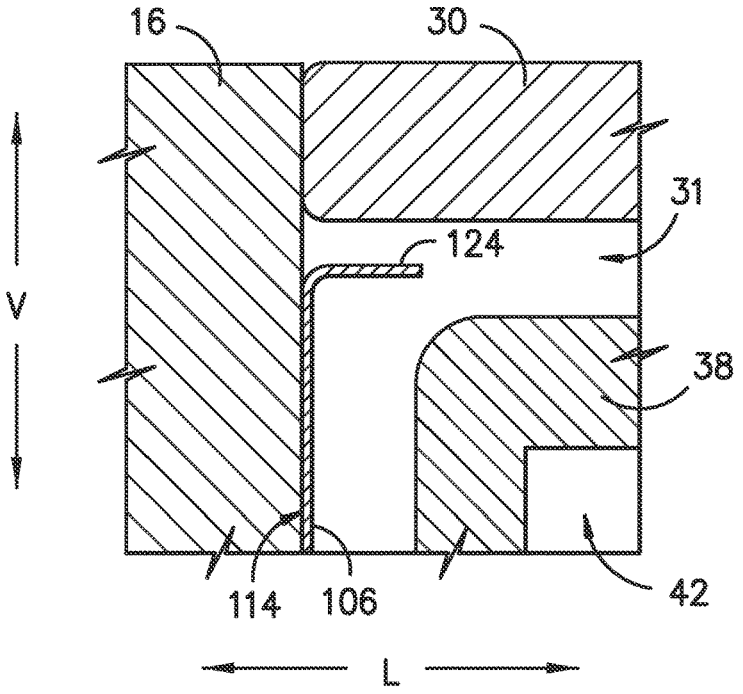
FIG. 15 provides another section view of a portion of the exemplary oven range appliance of FIG. 2, taken along the line 15-15 of FIG. 2.

Further, first portion 106 may include a first surface 114, third portion 110 may include a first surface 116, and rib portion 112 may include a first surface 118. As shown in FIGS. 12, 13, and 15, illustrating alternative views of the side panel of FIG. 4 and the oven range appliance 12 of FIG. 2, when oven range appliance 12 is received within base set of kitchen cabinets 16, first surfaces 114, 116, 118 are positioned adjacent cabinets 16. Second portion 108 is recessed such that second portion 108 is spaced apart from cabinets 16 along the lateral direction L, thereby defining a gap G between second portion 108 and cabinets 16. Gap G has a length equal to the distance between second portion 108 and cabinets 16 along the lateral direction L. Thus, air channels 130 may have a depth substantially equal to the length of gap G.

Figure 14:
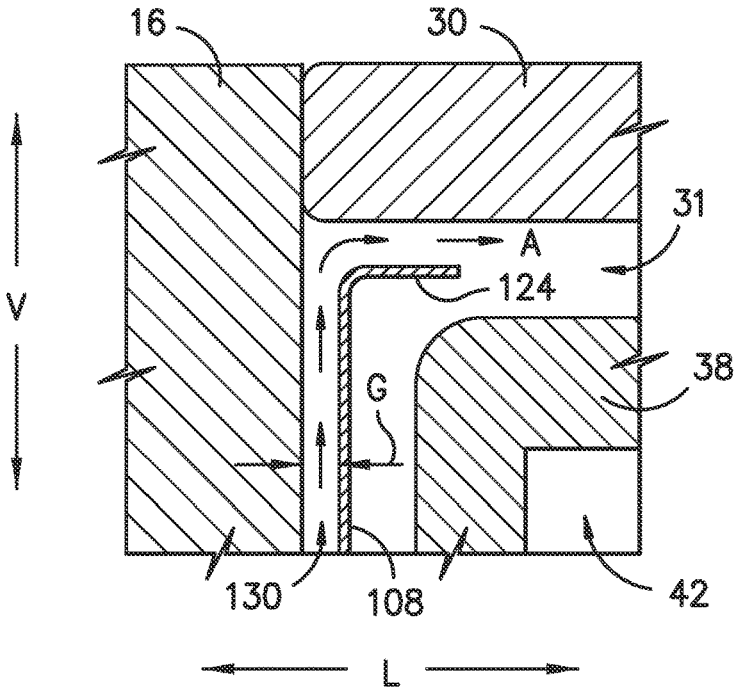
FIG. 14 provides a section view of a portion of the exemplary oven range appliance of FIG. 2, taken along the line 14-14 of FIG. 2.

As illustrated in FIGS. 2 and 14, air channels 130 thereby create a path for a flow of air A along side panel 100 from bottom end 104 to top end 102. When cooking chamber 42 and/or cooktop 30 of oven range appliance 12 are in use, side panel 100 becomes heated, and the air surrounding side panel 100 likewise is heated. Buoyancy drives the warmed air upward and entrains cooler air below, creating a flow of air A in air channels 130. For example, as shown in the illustrated embodiment of FIG. 2, cooler air may be entrained in air channels 130, e.g., from space 24 beneath oven range appliance 12, as warmer air rises. In some embodiments, forced convection through, e.g., a fan (not shown), may be used to augment or supplement the natural convection airflow A. Airflow A in air channels 130 helps to cool side panel 100 and protect cabinets 16 from excessive heat.

Figure 7:
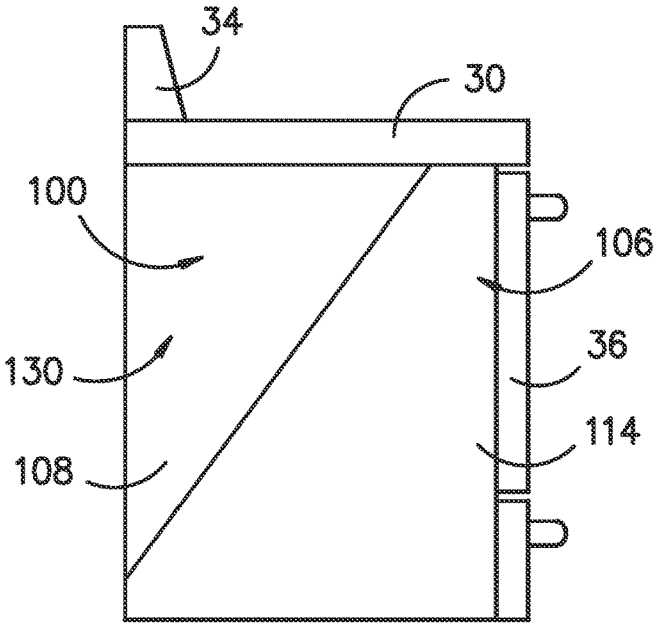
Figure 8:
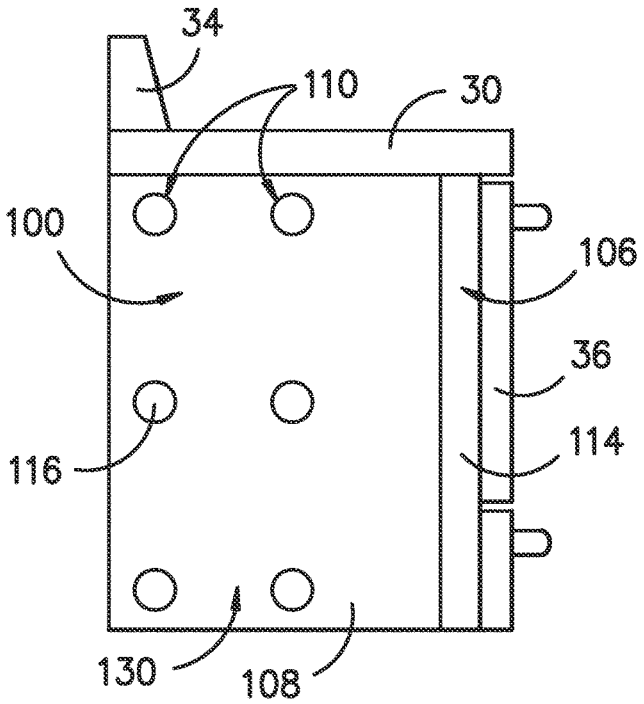

FIGS. 5 through 11 illustrate other exemplary embodiments of side panel 100. As shown in FIGS. 5, 7, 9, 10, and 11, in some embodiments, third portion 110 and rib portion 112 may be omitted. In other embodiments, such as the embodiment illustrated in FIG. 6, third portion 110 may be included and rib portion 112 may be omitted. Further, although in certain embodiments first portion 106, second portion 108, third portion 110, and/or rib portion 112 may be generally rectangular in shape and extend vertically between top end 102 and bottom end 104, first portion 106, second portion 108, third portion 110, and/or rib portion 112 may have other shapes and/or orientations, and second portion 108, third portion 110, and/or rib portion 112 may extend between all or a portion of the vertical distance between top end 102 and bottom end 104. For example, as shown in FIG. 7, first portion 106 and second portion 108 may have a non-rectangular shape and all or a part of first portion 106 and second portion 108 may extend at an angle to the vertical direction V along a portion of the vertical distance between top end 102 and bottom end 104. As a further example, side panel 100 may include a third portion 110 comprising one or more areas or segments positioned about second portion 108. These areas may be generally circular in shape as illustrated in FIG. 8, but the areas or segments forming third portion 110 may have other shapes as well.

Figure 9:
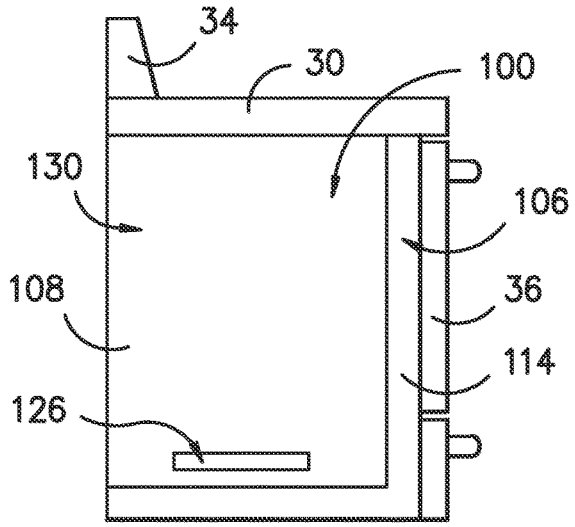
Figure 10:
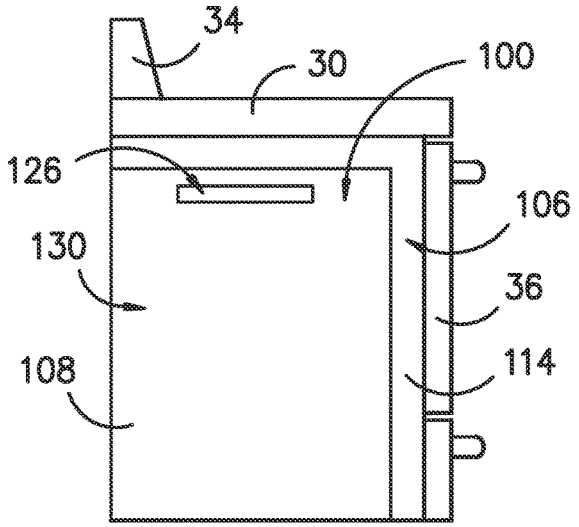
Figure 11:
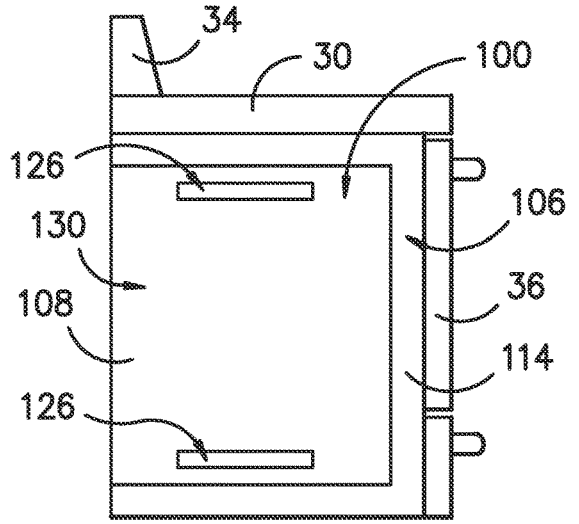

In still another example, as shown in FIGS. 9 through 11, first portion 106 may be generally L-shaped or C-shaped, i.e., first portion 106 may extend both along the vertical direction V adjacent front portion 45 and along the transverse direction T adjacent bottom end 104; first portion 106 may extend both along the vertical direction V adjacent front portion 45 and along the transverse direction T adjacent top end 102; or first portion 106 may extend along the vertical direction V adjacent front portion 45 and along the transverse direction T adjacent both bottom end 104 and top end 102. Additionally, in some embodiments, such as the embodiments of, e.g., FIGS. 4, 5, 6, 8, 9, 10, and 11, second portion 108 may form the majority of side panel 100; in other embodiments, such as the embodiment of FIG. 7, first portion 106, third portion 110, and/or rib portion 112 may comprise the majority of side panel 100. Other configurations of side panel 100 may be used as well.

Like the exemplary embodiment of side panel 100 shown in FIG. 4, in the exemplary embodiments shown in FIGS. 5, 7, 8, 9, 10, and 11, second portion 108 is recessed along the lateral direction L such that first portion 106 and second portion 108 form air channel 130. In the embodiment illustrated in FIG. 6, first portion 106, recessed second portion 108, and third portion 110 form air channel 130. Other configurations of air channel 130 may also be used.

Moreover, as illustrated by the alternative embodiments of side panel 100, some embodiments have only first portion 106, such that only first surface 114 is positioned adjacent cabinets 16 when oven range appliance 12 is received within kitchen cabinets 16. In other embodiments such as, e.g., the exemplary embodiment of FIG. 8, third portion 110 may include a plurality of areas or segments spaced apart from first portion 106 along the transverse direction T, each area of third portion 110 having a first surface 116 that may be positioned adjacent cabinets 16. In this way, the areas or segments forming third portion 110 are standoffs that assist in maintaining gap G defined between second portion 108 and cabinets 16.

Additionally, in alternative embodiments, such as the embodiments illustrated in FIGS. 5 through 11, cooler air may enter air channel 130 at a different location than bottom end 104, e.g., from a space (not shown) between back portion 47 of casing 40 and kitchen cabinets 16 or a kitchen wall and/or through one or more apertures 126 in side panel 100 positioned adjacent bottom end 104. For example, as shown in FIGS. 9 and 11, an aperture 126 may be positioned above bottom end 104 along the vertical direction V for the intake of cooler air. Similarly, warmer air may exit air channel 130 at a different location than top end 102, such as, e.g., into the space adjacent back portion 47 and/or through one or more apertures 126 in side panel 100 positioned adjacent top end 102. For example, as illustrated in FIGS. 10 and 11, an aperture 126 may be positioned below top end 102 along the vertical direction V for the egress of warmer air. Thus, in such alternative embodiments, the flow of air A flows along side panel 100 but may not flow from bottom end 104 to top end 102; rather, airflow A may flow along a portion of the vertical distance between bottom end 104 and top end 102. Other configurations for the intake of cooler air into air channels 130 and the discharge of warmer air from air channels 130 may also be used.

Accordingly, as side panel 100 and air surrounding side panel 100 become heated, air channels 130 provide a path for the cooler air to reach side panel 100 and help cool the side panel, as well as a path for the heated air to be directed away from side panel 100. As illustrated in FIGS. 14 and 15, a space 31 may be defined between cooktop 30 and layer of insulation 38. Side panel 100 may be positioned adjacent layer of insulation 38, such that airflow A within air channel 130, having a depth equal to gap G defined by second portion 108 and kitchen cabinets 16 as described, flows along side panel 100 and exits into space 31. The flow of air A exiting air channels 130 may be directed away from air channels 130 through space 31 into one or more vent paths for venting a flow of fluid F, such as, e.g., heated air, fumes, and/or gases, from cooking chamber 42 through one or more vents 64, as shown in FIGS. 2 and 3. Vents 64 may include one or more outlets positioned at or near, e.g., front portion 45 of casing 40 or under control panel 34.

In addition, as illustrated in FIGS. 4, 12, and 13, first portion 106 of side panel 100 may also include a second surface 120 extending generally perpendicular to first surface 114 of first portion 106. Second surface 120 may extend generally parallel to front portion 45 of casing 40. In some embodiments, second surface 120 may be substantially J-shaped, as shown in FIG. 13, such that part of second surface 120 is perpendicular to first surface 114 and another part of second surface 120 is parallel to first surface 114. When first surface 114 is positioned against base set of kitchen cabinets 16, second surface 120 forms a front edge of side panel 100 such that gap G between second portion 108 and cabinets 16 is hidden from view, i.e., gap G and air channels 130 are located behind second surface 120 along the transverse direction T. This feature of side panel 100 helps eliminate visible gaps between oven range appliance 12 and cabinets 16, which may be undesirable to users of appliance 12.

Further, in embodiments of side panel 100 including third portion 110, third portion 110 may include a second surface 122 extending generally perpendicular to first surface 116 of third portion 110 and generally parallel to back portion 47 of casing 40. Side panel 100 also may include a top portion 124 extending along top end 102 of side panel 100 between second surface 120 of first portion 106 and second surface 122 of third portion 110. Top portion 124 may, e.g., help direct the flow of air A from air channels 130 toward space 31 between cooktop 30 and layer of insulation 38.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An oven range appliance defining a vertical direction, a lateral direction, and a transverse direction that are perpendicular to each other, the oven range appliance comprising:

a casing defining a cooking chamber for receipt of food items for cooking, the casing extending vertically from a bottom portion to a top portion, the casing having a pair of opposing side panels, wherein at least one side panel of the pair of opposing side panels comprises a bottom end and a top end, the side panel extending along the vertical direction from the bottom end to the top end, the bottom end positioned at the bottom portion of the casing, a first portion extending from the bottom end to the top end and including a first surface, and a second portion extending from the bottom end to the top end such that the first portion and the second portion are co-extensive along the vertical direction, the second portion including a surface that is recessed along the lateral direction with respect to the first surface such that the first portion and second portion define an air channel for a flow of air along the at least one side panel, wherein the air channel extends from an air channel bottom end to an air channel top end and is open at the air channel bottom end and the air channel top end to create a path for the flow of air from the air channel bottom end to the air channel top end, the air channel bottom end coinciding with the bottom end of the side panel and the air channel top end coinciding with the top end of the side panel, and wherein the second portion forms the majority of the at least one side panel; and a plurality of feet for supporting the oven range appliance on a floor such that a space is defined between the casing and the floor, wherein the bottom end of the air channel is positioned at the space between the casing and the floor.

2. The oven range appliance of claim 1, wherein the at least one side panel further comprises a rib portion, and wherein the first portion, second portion, and rib portion define two air channels for the flow of air along the at least one side panel.

3. The oven range appliance of claim 1, wherein the first surface is positioned adjacent a set of kitchen cabinets such that a gap is defined between the set of kitchen cabinets and the second portion when the oven range appliance is received within the set of kitchen cabinets.

4. The oven range appliance of claim 3, wherein the first portion further comprises a second surface that extends generally parallel to a front portion of the casing and generally perpendicular to the first surface of the first portion such that the gap is not visible when the oven range appliance is received within the set of kitchen cabinets.

5. The oven range appliance of claim 1, wherein the at least one side panel further comprises an aperture adjacent the bottom end for the intake of cooler air into the air channel.

6. The oven range appliance of claim 1, wherein the at least one side panel further comprises an aperture adjacent the top end for the exit of warmer air from the air channel.

7. The oven range appliance of claim 1, further comprising at least one vent for directing the flow of air exiting the air channel away from the air channel.

8. The oven range appliance of claim 1, further comprising a cooktop, wherein a space is defined between the cooktop and the cooking chamber, and wherein the flow of air exits the air channel into the space.

9. A side panel for an oven range appliance, comprising:

a bottom end and a top end, the side panel extending along a vertical direction from the bottom end to the top end;

a front side and a back side, the side panel extending along a transverse direction from the front side to the back side;

a first portion extending from the bottom end to the top end and including a first surface, the first portion extending along the front side;

a second portion extending from the bottom end to the top end;

a third portion extending from the bottom end to the top end and including a first surface, the third portion extending along the back side; and a rib portion extending from the bottom end to the top end and including a first surface, the rib portion positioned equidistant from the first portion and the third portion, wherein the second portion includes a surface that is recessed along a lateral direction with respect to the first surface of each of the first portion, third portion, and rib portion such that the first portion, rib portion, and second portion define a first air channel for a flow of air along the side panel and the third portion, rib portion, and second portion define a second air channel for a flow of air along the side panel, wherein each of the first and second air channel extends from an air channel bottom end to an air channel top end and is open at the air channel bottom end and the air channel top end to create a path for the flow of air from the air channel bottom end to the air channel top end, each air channel bottom end coinciding with the bottom end of the side panel and each air channel top end coinciding with the top end of the side panel, and wherein the second portion forms the majority of the side panel.

10. The side panel of claim 9, further comprising a rib portion, wherein the first portion, second portion, and rib portion define two air channels for the flow of air along the side panel.

11. The side panel of claim 9, wherein the first surface is positioned adjacent a set of kitchen cabinets such that a gap is defined between the set of kitchen cabinets and the second portion when the oven range appliance is received within the set of kitchen cabinets.

12. The side panel of claim 11, wherein the first portion further comprises a second surface that extends generally parallel to a front portion of a casing of the oven range appliance and generally perpendicular to the first surface such that the gap is not visible when the oven range appliance is received within the set of kitchen cabinets.

13. The side panel of claim 9, wherein the oven range appliance comprises a plurality of feet for supporting the oven range appliance on a floor such that a space is defined between a casing of the oven range appliance and the floor, and wherein the bottom end of the side panel is positioned adjacent the space between the casing and the floor.

14. The side panel of claim 9, wherein the oven range appliance comprises at least one vent for directing the flow of air exiting the air channel away from the air channel.

15. A side panel for an oven range appliance, comprising:

a bottom end and a top end, the side panel extending along a vertical direction from the bottom end to the top end;

a front side and a back side, the side panel extending along a transverse direction from the front side to the back side;

a first portion including a first surface;

a second portion including a surface that is recessed along a lateral direction with respect to the first surface such that the first portion and second portion define an air channel for a flow of air along the side panel; and a top portion extending across the top end from the front side to the back side, wherein the air channel is open at the back side or the bottom end to create a path for the flow of air along the side panel, wherein the first portion extends from the bottom end to the top end along the front side, wherein the side panel is positioned below a cooktop of the oven range appliance such that the top portion is positioned within a space defined between the cooktop and a cooking chamber of the oven range appliance, and wherein the flow of air exits the air channel into the space.

16. The side panel of claim 15, further comprising an aperture adjacent the bottom end for the intake of cooler air into the air channel.

17. The side panel of claim 15, further comprising an aperture adjacent the top end for the exit of warmer air from the air channel.

18. The side panel of claim 15, wherein the first portion is generally L-shaped.

19. The side panel of claim 15, further comprising a third portion formed by a plurality of segments.

* * * * *